US009039557B2

(12) United States Patent
Naughton et al.

(10) Patent No.: US 9,039,557 B2
(45) Date of Patent: May 26, 2015

(54) POWERED DISPENSING TOOL

(75) Inventors: Michael Naughton, Oconomowoc, WI (US); Anna M. Kaczmarczyk, Racine, WI (US); John G. Marx, Hartford, WI (US); David P. Lincoln, Milwaukee, WI (US); Joseph H. Ellice, Greenfield, WI (US); Troy C. Thorson, Cedarburg, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 363 days.

(21) Appl. No.: 13/599,462

(22) Filed: Aug. 30, 2012

(65) Prior Publication Data

US 2013/0055834 A1 Mar. 7, 2013

Related U.S. Application Data

(60) Provisional application No. 61/530,597, filed on Sep. 2, 2011.

(51) Int. Cl.

| | |
|---|---|
| ***B05C 17/00*** | (2006.01) |
| ***F16H 19/04*** | (2006.01) |
| ***B05C 17/01*** | (2006.01) |

(52) U.S. Cl.

CPC ..... *B05C 17/0103* (2013.01); *Y10T 74/18096* (2015.01)

(58) Field of Classification Search

CPC ..... B05C 17/0103; B05C 17/0116; B05C 17/014; G06F 1/1677; G06F 1/1679; F16D 2123/00; F16D 29/005

USPC ..... 74/30, 625, 665; 475/149, 154, 155, 475/156, 302, 343; 222/63, 52, 333, 326, 222/327, 325, 386, 391, 328, 504; 425/149, 425/154, 155, 156, 302, 343; 221/279

See application file for complete search history.

(56) References Cited

U.S. PATENT DOCUMENTS

| | | | |
|---|---|---|---|
| 966,861 | A | 8/1910 | Rubly |
| 1,269,438 | A | 6/1918 | Hieatzman |

(Continued)

FOREIGN PATENT DOCUMENTS

| | | |
|---|---|---|
| CA | 2570384 | 12/2005 |
| DE | 3418630 | 11/1985 |

(Continued)

OTHER PUBLICATIONS

Cox, Product Catalog, 2004 (16 pages).

(Continued)

*Primary Examiner* — William Kelleher
*Assistant Examiner* — Valentin Craciun
(74) *Attorney, Agent, or Firm* — Michael Best & Friedrich LLP

(57) ABSTRACT

A powered dispensing tool includes a housing, a motor at least partially positioned within the housing, a rack operably coupled to the motor for powered translation, and a transmission selectively operably coupling the motor and the rack. The transmission includes an output shaft rotatable in response to rotation of the motor, and an output member drivably coupled to the rack and supported on the output shaft for relative rotation therewith. The transmission also includes a clutch member coupled for co-rotation with the output shaft and movable along the output shaft between a first position, in which the clutch member is engaged with the output member for transferring torque from the output shaft to the output member, and a second position, in which the clutch member is disengaged from the output member to inhibit torque transfer between the output shaft and the output member.

16 Claims, 6 Drawing Sheets

(56) References Cited

U.S. PATENT DOCUMENTS

| | | | | |
|---|---|---|---|---|
| 3,208,638 | A | 9/1965 | Frenzel et al. | |
| 3,300,100 | A | 1/1967 | Sundholm | |
| 3,341,084 | A | 9/1967 | Sundholm | |
| 3,341,085 | A | 9/1967 | Sundholm | |
| 3,640,431 | A | 2/1972 | Plumer | |
| 3,730,394 | A | 5/1973 | Woodson | |
| 3,768,472 | A | 10/1973 | Hodosh et al. | |
| 3,782,598 | A | 1/1974 | Basa | |
| 3,813,012 | A | 5/1974 | Laird | |
| 3,870,200 | A | 3/1975 | Spatz | |
| 3,997,085 | A | 12/1976 | Lindquist | |
| 4,113,151 | A | 9/1978 | Brown et al. | |
| 4,135,644 | A | 1/1979 | Pacetti | |
| 4,171,072 | A * | 10/1979 | Davis, Jr. | 222/326 |
| 4,260,076 | A | 4/1981 | Bergman | |
| 4,277,194 | A | 7/1981 | Smith | |
| 4,330,070 | A | 5/1982 | Doubleday | |
| 4,339,058 | A | 7/1982 | Wendt | |
| 4,556,156 | A | 12/1985 | Frutin | |
| 4,570,832 | A | 2/1986 | Kroger | |
| 4,583,934 | A * | 4/1986 | Hata et al. | 425/376.1 |
| 4,595,124 | A | 6/1986 | Duval et al. | |
| 4,615,469 | A * | 10/1986 | Kishi et al. | 222/327 |
| 4,715,518 | A | 12/1987 | Moore | |
| 4,840,293 | A | 6/1989 | Segatz | |
| 4,854,485 | A | 8/1989 | Collins | |
| 4,871,088 | A | 10/1989 | Cox | |
| 4,872,596 | A | 10/1989 | Corsette | |
| 4,877,156 | A | 10/1989 | Clanet et al. | |
| 4,890,773 | A | 1/1990 | Corsette | |
| 4,907,727 | A | 3/1990 | Ernst et al. | |
| 4,986,454 | A * | 1/1991 | Riley | 222/327 |
| 5,027,984 | A | 7/1991 | Gakhar et al. | |
| 5,050,773 | A * | 9/1991 | Choi | 222/63 |
| 5,088,630 | A | 2/1992 | Arch et al. | |
| 5,139,178 | A | 8/1992 | Arch et al. | |
| 5,161,715 | A | 11/1992 | Giannuzzi | |
| 5,176,291 | A | 1/1993 | Fillmore et al. | |
| 5,240,152 | A | 8/1993 | Scholz | |
| 5,273,190 | A | 12/1993 | Lund | |
| 5,295,614 | A | 3/1994 | Chang | |
| 5,323,931 | A | 6/1994 | Robards, Jr. et al. | |
| 5,353,962 | A | 10/1994 | Scholz et al. | |
| 5,370,271 | A | 12/1994 | Segatz | |
| 5,390,831 | A | 2/1995 | Schneider | |
| 5,405,054 | A | 4/1995 | Thomas | |
| 5,413,255 | A | 5/1995 | Dent | |
| 5,419,466 | A | 5/1995 | Scheindel | |
| 5,441,175 | A | 8/1995 | Jacobsen et al. | |
| 5,464,128 | A | 11/1995 | Keller | |
| 5,492,249 | A | 2/1996 | Beach | |
| 5,556,009 | A * | 9/1996 | Motzko | 222/326 |
| 5,593,066 | A | 1/1997 | Konuma et al. | |
| 5,699,935 | A | 12/1997 | Stahley | |
| 5,762,239 | A * | 6/1998 | Cossette | 222/326 |
| 5,775,533 | A | 7/1998 | Schroeder | |
| 5,775,539 | A * | 7/1998 | Bates et al. | 222/1 |
| 5,788,123 | A | 8/1998 | Hackmann et al. | |
| 5,826,751 | A | 10/1998 | Stahley et al. | |
| 5,842,604 | A | 12/1998 | Stahley et al. | |
| 5,860,568 | A | 1/1999 | Mallalieu et al. | |
| 5,897,028 | A | 4/1999 | Sauer | |
| 5,909,830 | A * | 6/1999 | Bates et al. | 222/327 |
| 6,039,215 | A | 3/2000 | Bell | |
| 6,039,216 | A | 3/2000 | Cummings | |
| 6,082,597 | A | 7/2000 | Beckett et al. | |
| 6,123,235 | A * | 9/2000 | Hsu | 222/327 |
| 6,152,334 | A | 11/2000 | Liardon et al. | |
| 6,220,485 | B1 | 4/2001 | Chang | |
| 6,241,130 | B1 | 6/2001 | Heiberger | |
| 6,299,022 | B1 | 10/2001 | Bublewitz et al. | |
| 6,321,951 | B1 | 11/2001 | Frutin | |
| 6,386,400 | B1 | 5/2002 | Scheindel | |
| 6,415,955 | B1 | 7/2002 | Ostreicher | |
| 6,454,129 | B1 | 9/2002 | Green | |
| 6,474,510 | B2 | 11/2002 | Frutin | |
| 6,478,190 | B2 | 11/2002 | Kuge et al. | |
| 6,488,180 | B1 | 12/2002 | Bayat | |
| 6,494,345 | B2 | 12/2002 | Schrader | |
| 6,494,662 | B1 * | 12/2002 | De Montalembert | 414/1 |
| 6,508,385 | B1 | 1/2003 | Liardon | |
| 6,578,738 | B1 | 6/2003 | Keller | |
| 6,634,524 | B1 | 10/2003 | Helmenstein | |
| 6,701,828 | B1 | 3/2004 | Burns et al. | |
| 6,742,722 | B2 | 6/2004 | Hosoda et al. | |
| 6,745,921 | B2 * | 6/2004 | Beckett | 222/391 |
| 6,752,293 | B2 | 6/2004 | So | |
| 6,789,707 | B2 | 9/2004 | Wright | |
| 6,889,872 | B2 * | 5/2005 | Herman et al. | 222/82 |
| 7,163,130 | B2 | 1/2007 | Lafond | |
| 7,192,267 | B2 | 3/2007 | Glucksman et al. | |
| 7,431,136 | B2 * | 10/2008 | Simm et al. | 192/34 |
| 7,445,135 | B2 | 11/2008 | Miyata et al. | |
| 7,637,392 | B2 * | 12/2009 | Hsu et al. | 222/137 |
| 7,690,530 | B2 | 4/2010 | Schneider et al. | |
| 7,913,881 | B2 | 3/2011 | Herman | |
| 8,011,538 | B2 | 9/2011 | Herman et al. | |
| 8,020,727 | B2 | 9/2011 | Herman et al. | |
| 8,387,825 | B2 * | 3/2013 | Herman et al. | 222/1 |
| 8,424,718 | B2 * | 4/2013 | Wagner et al. | 222/1 |
| 2001/0042762 | A1 | 11/2001 | Reichert | |
| 2004/0045982 | A1 | 3/2004 | Herman et al. | |
| 2005/0051571 | A1 | 3/2005 | Carruth et al. | |
| 2007/0235475 | A1 | 10/2007 | Schneider et al. | |
| 2008/0197154 | A1 | 8/2008 | Herman et al. | |
| 2009/0039113 | A1 * | 2/2009 | Hsu et al. | 222/333 |
| 2009/0065527 | A1 | 3/2009 | Buck | |
| 2009/0110786 | A1 | 4/2009 | Wells | |
| 2009/0179045 | A1 | 7/2009 | Cadden | |
| 2009/0272761 | A1 | 11/2009 | Cadden | |
| 2009/0272767 | A1 | 11/2009 | Herman et al. | |
| 2009/0277970 | A1 | 11/2009 | Lind et al. | |
| 2009/0302055 | A1 | 12/2009 | Cadden et al. | |
| 2010/0006605 | A1 * | 1/2010 | Sung et al. | 222/327 |
| 2011/0030980 | A1 * | 2/2011 | Ho | 173/1 |
| 2011/0278327 | A1 | 11/2011 | Herman et al. | |
| 2012/0118913 | A1 * | 5/2012 | Naughton | 222/137 |
| 2012/0118917 | A1 * | 5/2012 | Naughton et al. | 222/333 |

FOREIGN PATENT DOCUMENTS

| | | |
|---|---|---|
| DE | 3811954 | 10/1989 |
| EP | 0343003 | 11/1989 |
| EP | 0836534 | 9/2002 |
| WO | 0171293 | 9/2001 |
| WO | 2006015596 | 2/2006 |
| WO | 2008/048319 | 4/2008 |

OTHER PUBLICATIONS

Cox, Catalogs, Apr. 4, 2005, (date according to waybackmachine.com), {Retrieved May 24, 2011} Retrieved from the Internet <URL: http://www.cox-applicators.com/catalogs.asp>.

Milwaukee Electric Tool Corporation, 14.4V Cordless Caulk & Adhesive Gun Kits, Online Product Sheet, Jun. 25, 2006, (date according to waybackmachine.com), {Retrieved on May 24, 2011} Retrieved from the Internet <URL: http://www.mytoolstore.com/milwauke/6562>.

Milwaukee Electric Tool Corporation, Tool Catalog: Heavy-Duty Caulk & Adhesive Guns, 2003 (3 pages).

Milwaukee Electric Tool Corporation, Cordless 2.4 Volt Screwdriver and Cordless 2.4 Volt Caulking Gun, 1997 (2 pages).

Milwaukee Electric Tool Corporation, 14.4 Cordless Caulk Gun Service Parts List, Oct. 2006 ( 2 pages).

Milwaukee Electric Tool Corporation, 14.4 Cordless Caulk Gun Operator's Manual, Oct. 2006 (21 pages).

* cited by examiner

POWERED DISPENSING TOOL

CROSS-REFERENCE TO RELATED APPLICATIONS

This application claims priority to U.S. Provisional Patent Application No. 61/530,597 filed Sep. 2, 2011, the entire content of which is incorporated herein by reference.

FIELD OF THE INVENTION

The present invention relates to power tools, and more particularly to powered dispensing tools

BACKGROUND OF THE INVENTION

Dispensing tools, such as those used for dispensing caulk, adhesives, or the like materials, are typically manually operated by squeezing or grasping a handle of the dispensing tool. The handle is typically connected to a rack via an advancing mechanism (e.g., a ratchet and pawl-type mechanism) to incrementally advance the rack and cause the caulk, adhesive, or like material to be discharged from a cartridge. Such manually operated dispensing tools can be difficult to control and strenuous, thereby fatiguing the user and possibly shortening the duration of time the manually operated dispensing tool may be used before the user requires rest.

SUMMARY OF THE INVENTION

The invention provides, in one aspect, a powered dispensing tool including a housing, a motor at least partially positioned within the housing, a rack operably coupled to the motor for powered translation in at least one of a forward direction and a reverse direction, and a transmission selectively operably coupling the motor and the rack. The transmission includes an output shaft that is rotatable in response to rotation of the motor, and an output member drivably coupled to the rack and supported on the output shaft for relative rotation therewith. The transmission also includes a clutch member that is coupled for co-rotation with the output shaft and movable along the output shaft between a first position, in which the clutch member is engaged with the output member for transferring torque from the output shaft to the output member, and a second position, in which the clutch member is disengaged from the output member to inhibit torque transfer between the output shaft and the output member.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
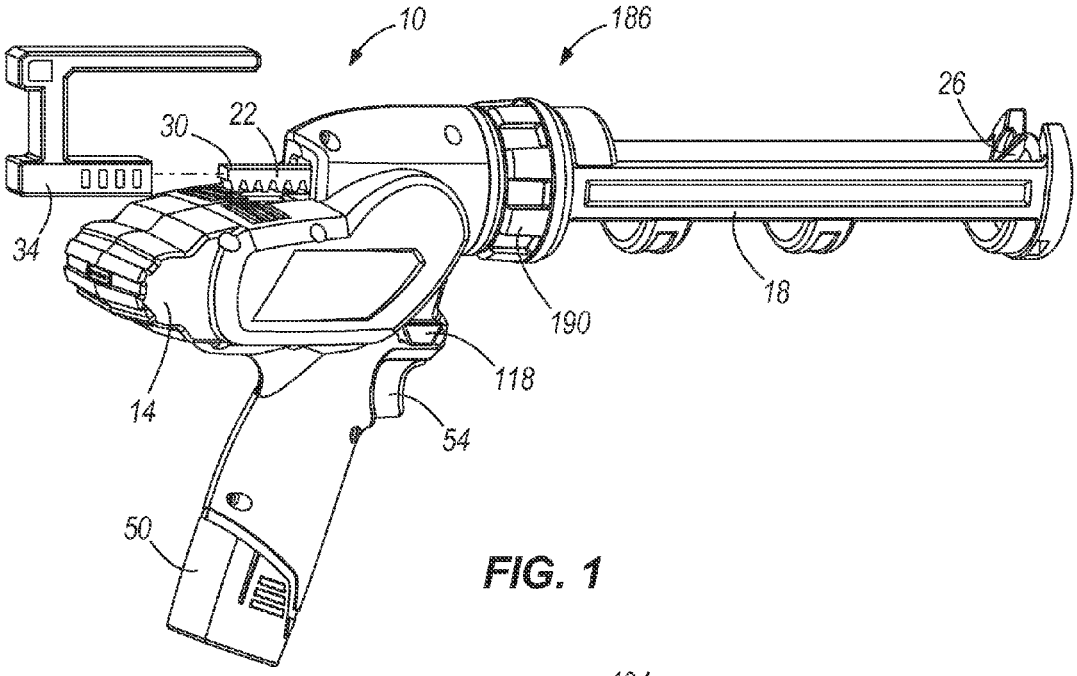
FIG. 1 is a perspective view of a powered dispensing tool of the invention.

FIG. 1 illustrates a powered dispensing tool 10 of the invention. The tool 10 includes a main housing 14 and a cartridge housing 18 attached to the main housing 14 for supporting a tubular cartridge of caulk, adhesive, or other material to be dispensed. The tool 10 also includes a rack 22 having a front end coupled to a plunger 26 and a rear end 30 accessible from the rear of the main housing 14. A handle 34 is coupled to the rear end 30 of the rack 22 to facilitate grasping the rack 22 to manually advance or retract the rack 22 relative to the main housing 14. As will be described in greater detail below, the plunger 26 is movable within the cartridge housing 18 in response to the rack 22 being driven or otherwise moved in a forward or reverse direction.

Figure 2:
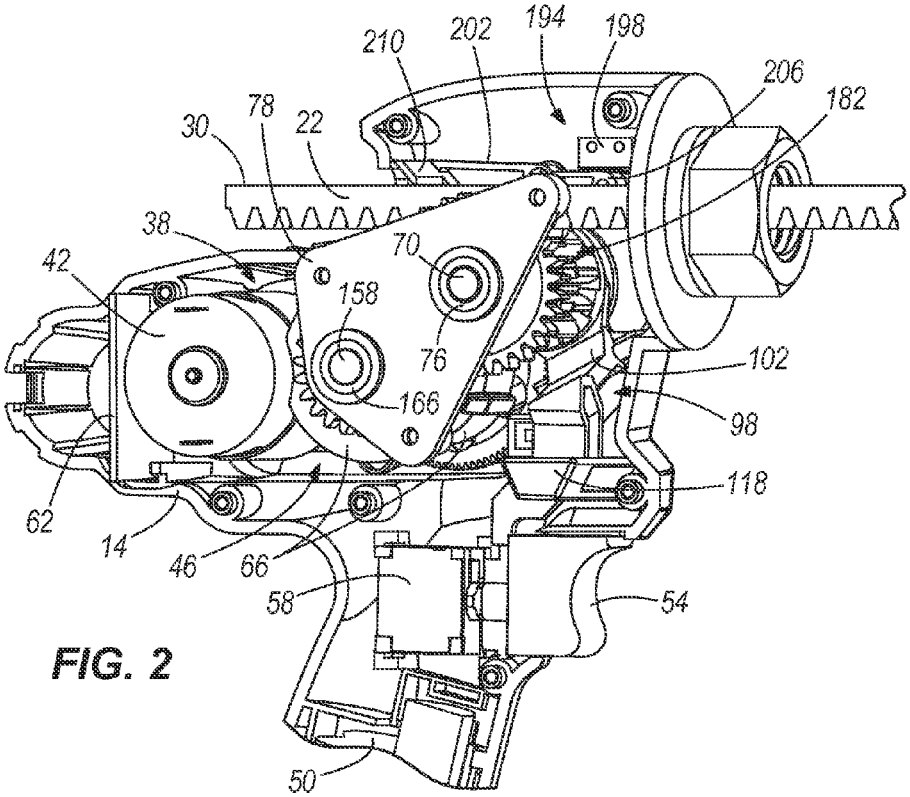
FIG. 2 is a cutaway view of a portion of the powered dispensing tool of FIG. 1, illustrating a motor and a transmission.
Figure 3:
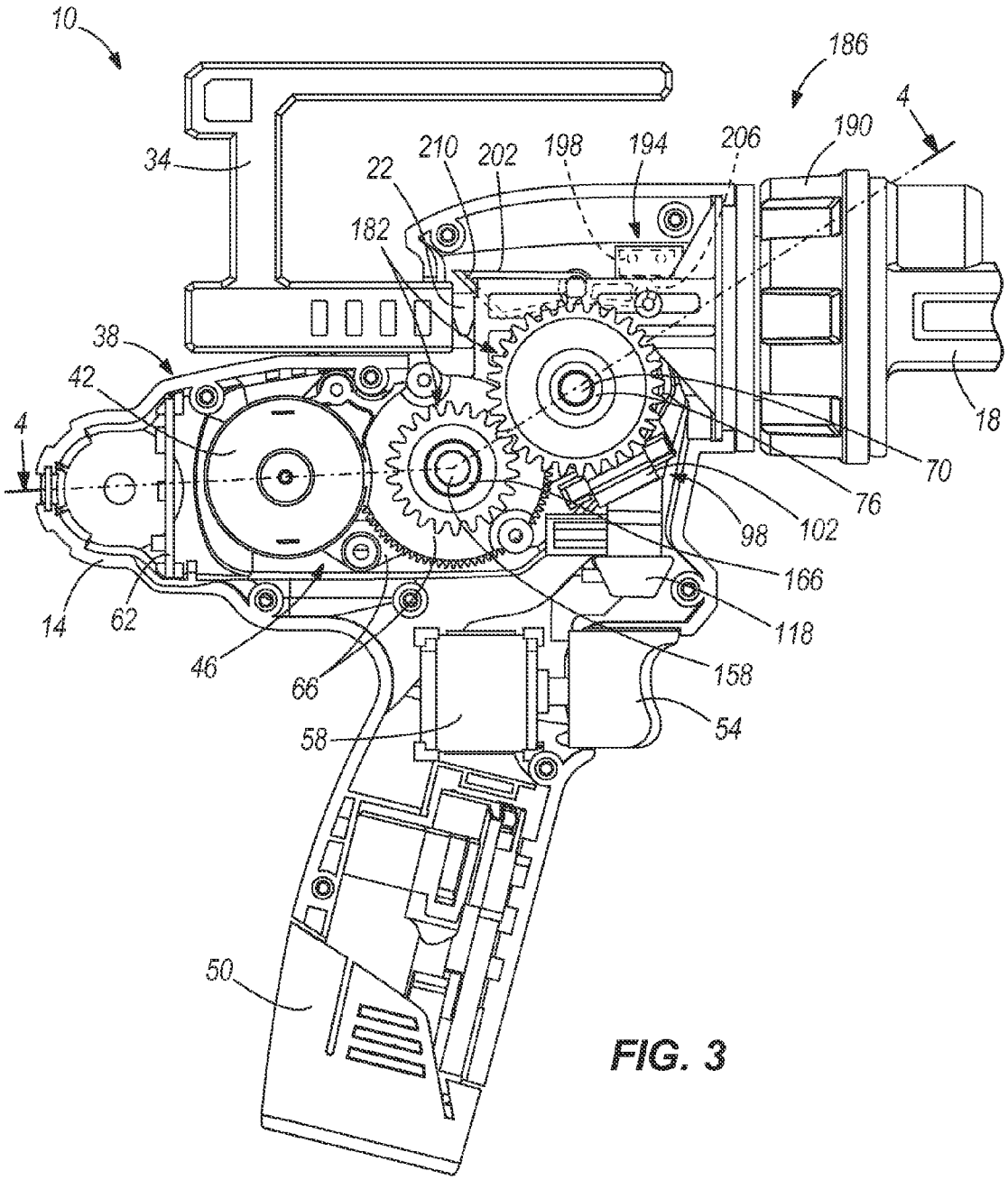
FIG. 3 is another cutaway view of a portion of the powered dispensing tool of FIG. 1, illustrating the motor and the transmission.
Figure 9:
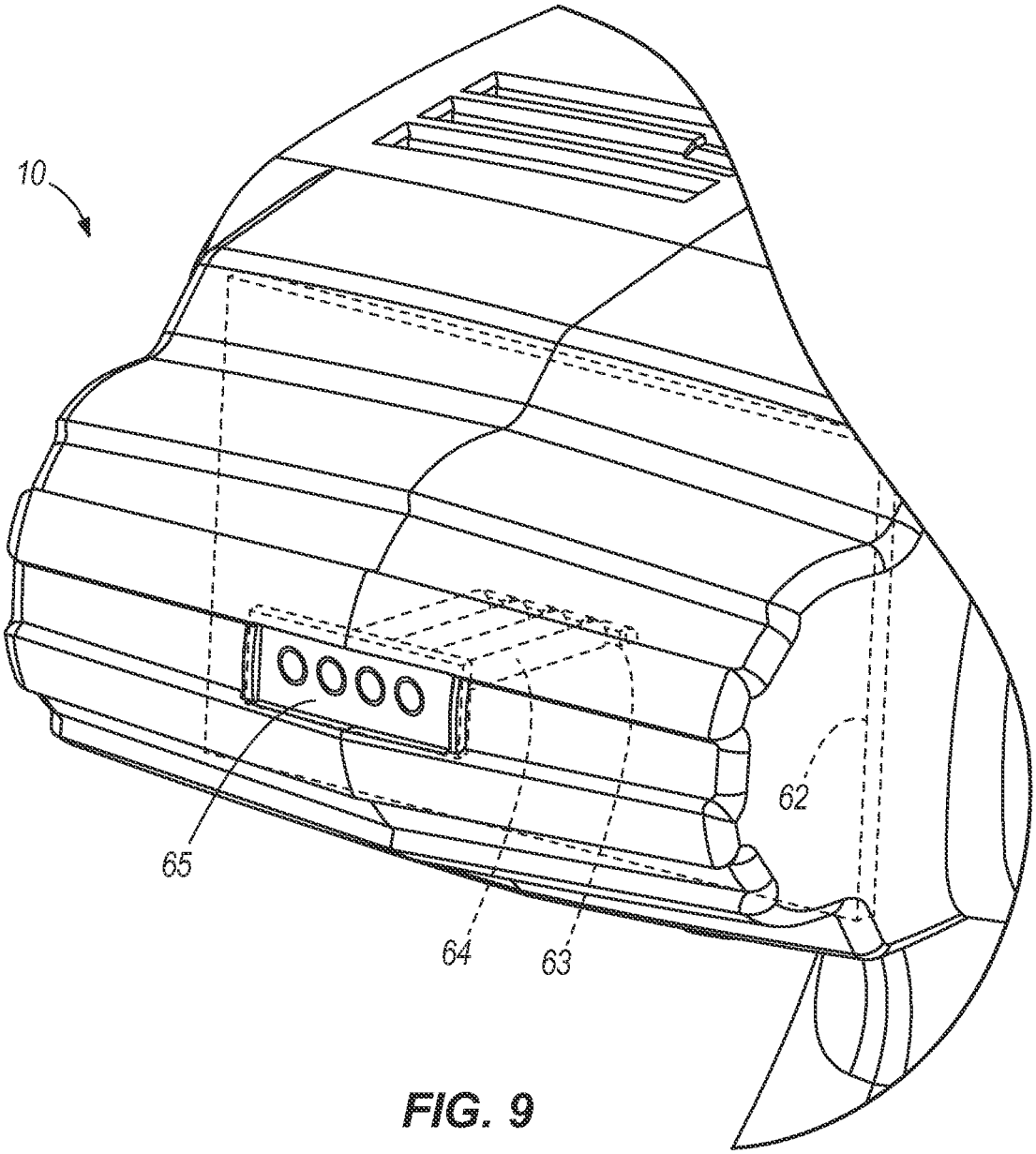
FIG. 9 is a rear perspective view of the powered dispensing tool of FIG. 1, illustrating a printed circuit board and a fuel gauge.

With reference to FIGS. 2 and 3, the tool 10 includes a power train assembly 38 positioned within the main housing 14. The power train assembly 38 includes an electric motor 42 and a transmission 46 for converting the rotational output of the motor 42 to a translational output of the rack 22. In the illustrated construction of the tool 10, the motor 42 is configured as a DC motor that receives power from an on-board power source (e.g., a battery 50). The battery 50 may include any of a number of different nominal voltages (e.g., 12V, 18V, etc.), and may be configured having any of a number of different chemistries (e.g., lithium-ion, nickel-cadmium, etc.). Alternatively, the motor 42 may be powered by a remote power source (e.g., a household electrical outlet) through a power cord. The motor 42 is selectively activated by depressing a trigger 54 which, in turn, actuates a switch 58. The switch 58 may be electrically connected to the motor 42 via a top-level or master controller or one or more circuits on a printed circuit board ("PCB") 62. The PCB 62 is located in the rear of the main housing 14. The PCB 62 includes a plurality of LEDs 63 (FIG. 9) and a corresponding plurality of light pipes 64 extending from the PCB 62 toward the rear of the main housing 14. The LEDs 63 on the PCB 62 and the light pipes 64 in combination define a fuel gauge 65 operable to display the remaining power available in the battery 50.

Figure 4:
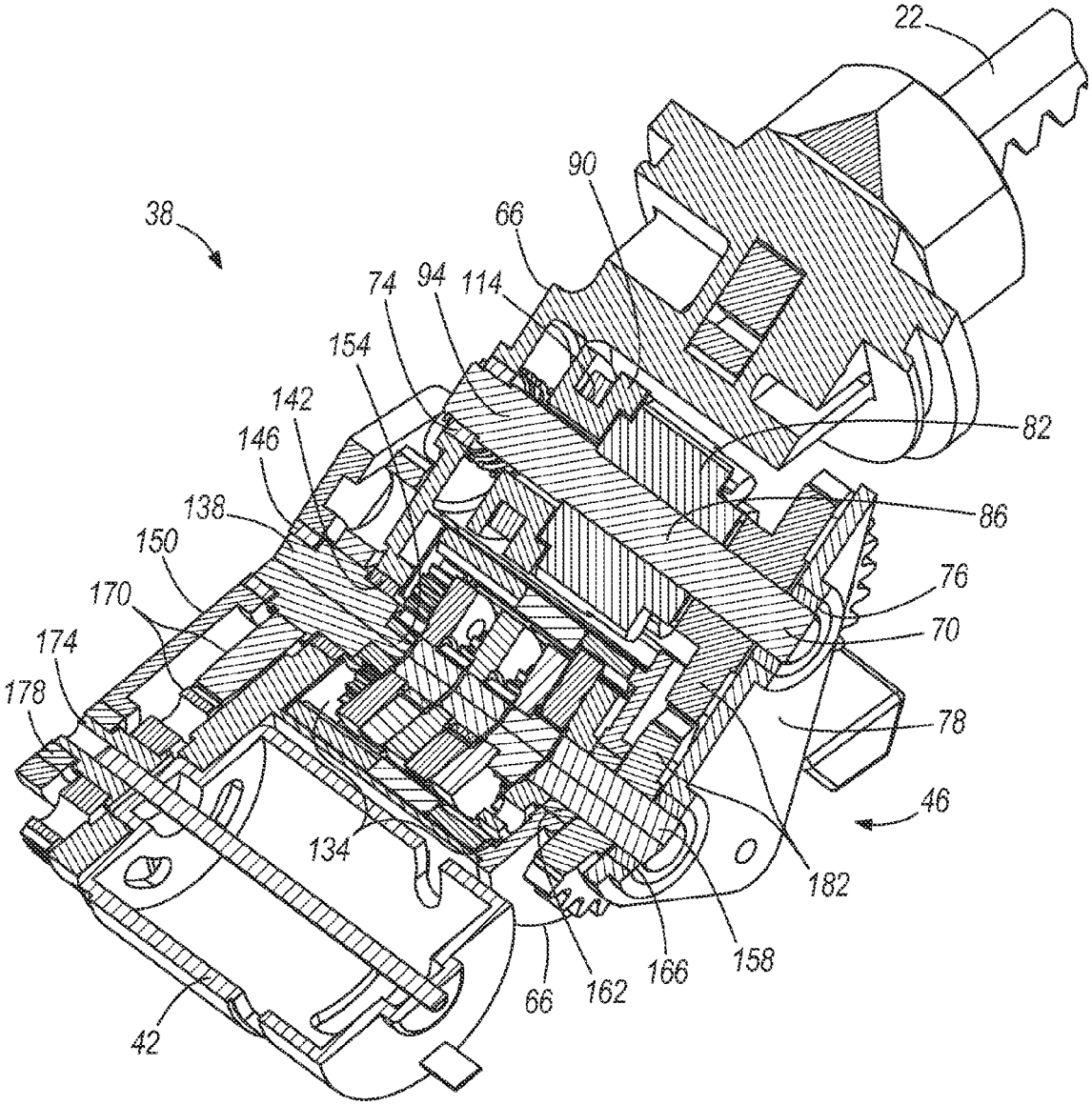
FIG. 4 is a cross-sectional view of the motor and the transmission of FIGS. 2 and 3 through line 4-4 in FIG. 3.

With reference to FIG. 4, the transmission 46 includes a transmission housing 66 and an output shaft 70 that is rotatable in response to receiving torque from the motor 42. One end of the output shaft 70 is supported for rotation in the transmission housing 66 by a bushing 74 mounted directly in the transmission housing 66. An opposite end of the output shaft 70 is supported for rotation by a bushing 76 mounted in a plate 78 which, in turn, is secured to the transmission housing 66 (e.g., by fasteners). The transmission 46 also includes an output member or gear 82 that is continuously engaged with the rack 22 and supported on a portion 86 of the output shaft 70 having a circular cross-sectional shape to permit the output gear 82 to be rotatable relative to the output shaft 70. As such, torque from the motor 42 cannot be directly transferred from the output shaft 70 to the output gear 82 via the circular portion 86 of the output shaft 70.

With continued reference to FIG. 4, the transmission 46 further includes a clutch member 90 that is coupled for co-rotation with the output shaft 70 and movable along the output shaft 70 between a first position (FIG. 5), in which the clutch member 90 is engaged with the output gear 82 for transferring torque from the output shaft 70 to the output gear 82, and a second position (FIG. 6), in which the clutch member 90 is disengaged from the output gear 82 to inhibit torque transfer between the output shaft 70 and the output gear 82. The clutch member 90 is supported upon a portion 94 of the output shaft 70 having a non-circular cross-sectional shape to facilitate co-rotation of the clutch member 90 and the output shaft 70, yet permit sliding movement of the clutch member 90 along the output shaft 70 between the first and second positions (FIG. 4). In the illustrated construction of the tool 10, the output shaft 70 includes opposed flats on its outer periphery to define the non-circular portion 94 of the output shaft 70. Alternatively, the non-circular portion 94 of the output shaft 70 may include any of a number of non-circular cross-sectional shapes.

Figure 5:
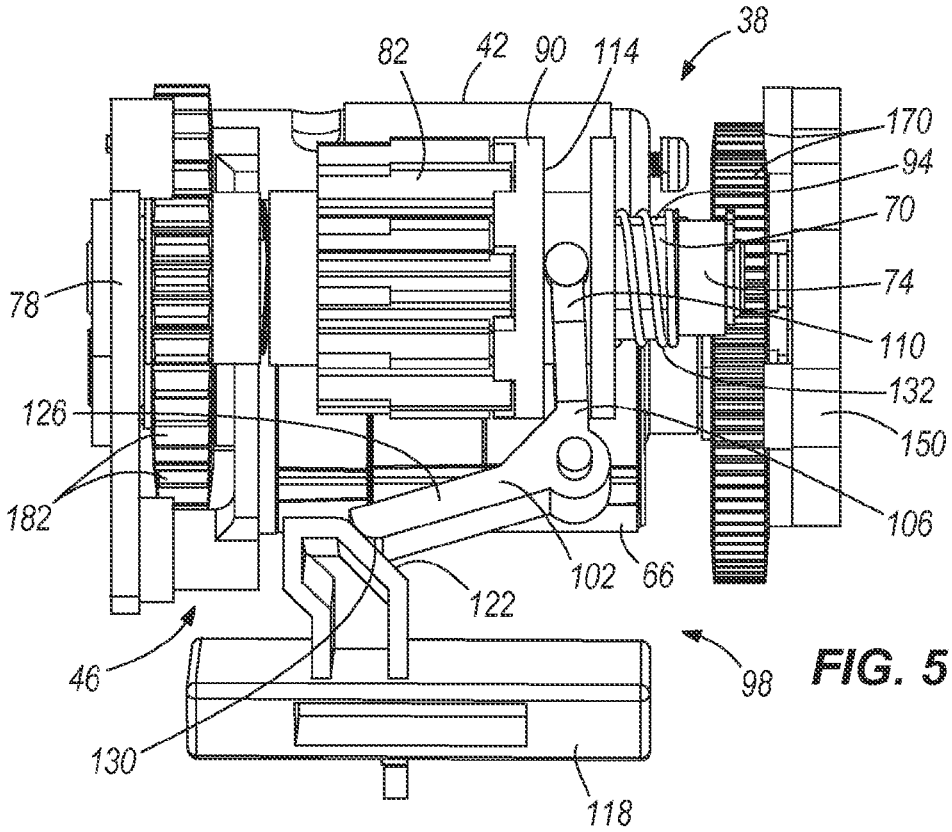
FIG. 5 is a plan view of a clutch member and an output member of the transmission of FIGS. 2 and 3, illustrating the clutch member engaged to the output member to permit powered translation of the rack.
Figure 6:
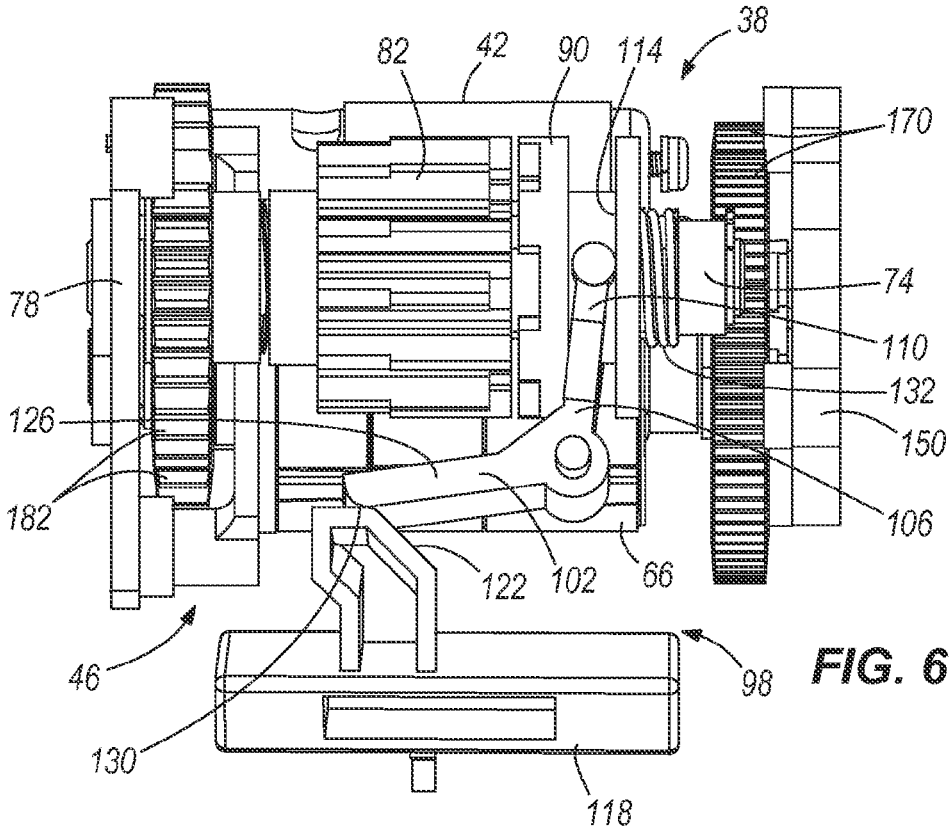
FIG. 6 is a plan view of the clutch member and the output member of the transmission of FIGS. 2 and 3, illustrating the clutch member disengaged from the output member to inhibit powered translation of the rack.

With reference to FIGS. 5 and 6, the powered dispensing tool 10 also includes an actuator 98 coupled to the clutch member 90 to facilitate moving the clutch member 90 between the first and second positions. The actuator 98 includes a lever 102 pivotably coupled to the housing 14 and having a first end 106 engageable with the clutch member 90. Particularly, the first end 106 of the lever 102 is configured as a fork 110 that defines a "U-shaped" cross-section and that is received within a circumferential groove 114 of the clutch member 90. As such, the fork 110 rides within the groove 114 at all times when the clutch member 90 is in the first position (FIG. 5) and when the clutch member 90 is in the second position (FIG. 6).

The actuator 98 also includes a slide member 118 that is supported by the housing 14 for sliding movement between a drive position (FIG. 5), in which the lever 102 is allowed to pivot to move the clutch member 90 toward the first position, and a release position (FIG. 6), in which the lever 102 is pivoted by the slide member 118 to move the clutch member 90 toward the second position. In the illustrated construction of the tool 10, the slide member 118 includes a cam surface 122 and a second end 126 of the lever 102 includes a follower surface 130 with which the cam surface 122 is engageable. Particularly, the cam surface 122 is configured to pivot the lever 102 in a clockwise direction from the frame of reference of FIG. 5, thereby disengaging the clutch member 90 from the output gear 82, in response to movement of the slide member 118 toward the right (i.e., the release position) from the frame of reference of FIG. 5.

The actuator 98 further includes a compression spring 132 that is engaged with the clutch member 90 for biasing the clutch member 90 toward the first position shown in FIG. 5. As such, when the slide member 118 is moved by the operator of the tool 10 from the release position toward the drive position, the follower surface 130 slides down the cam surface 122, thereby permitting the lever 102 to rotate in a counter-clockwise direction from the frame of reference of FIG. 6 and permitting the compression spring 132 to exert a restoring force on the clutch member 90 to move the clutch member 90 from the second position (FIG. 6) to the first position (FIG. 5) to re-engage the clutch member 90 and the output gear 82.

With reference to FIG. 4, the transmission 46 also includes a plurality of planetary stages 134 drivably coupling the motor 42 and the output shaft 70. In the illustrated construction of the tool 10, the transmission 46 includes four planetary stages 134 arranged in a direction parallel to the output shaft 70. Alternatively, the transmission 46 may include more or fewer planetary stages 134 depending upon the desired speed reduction from the transmission 46.

The transmission 46 also includes an input pinion 138 supported for rotation on opposite ends by a bushing 142 mounted directly in the transmission housing 66 and another bushing 146 mounted in a plate 150 which, in turn, is secured to the transmission housing 66 (e.g., by fasteners). As shown in FIG. 4, the input pinion 138 includes a sun gear 154 for driving the first planetary stage 134. The transmission 46 further includes an output pinion 158 supported for rotation on opposite ends by a bushing 162 mounted directly in the transmission housing 66 and another bushing 166 mounted in the plate 78. As shown in FIG. 4, the output pinion 158 is coupled for co-rotation to the carrier of the fourth planetary stage 134. As such, the plate 78 effectively functions as a spacer to maintain the alignment of the output shaft 70 and the output pinion, and therefore the planetary stages 134.

With continued reference to FIG. 4, the transmission 46 further includes a first spur gear reduction stage 170 interconnecting an output shaft 174 of the motor 42 with the input pinion 138. One end of the motor output shaft 174 is rotatably supported by a bushing 178 mounted in the plate 150. As such, the plate 150 effectively functions as a spacer to maintain the alignment of the motor output shaft 174 and the input pinion 138, and therefore the planetary stages 134. The transmission 46 also includes a second spur gear reduction stage 182 interconnecting the output pinion 158 and the output shaft 70. The first and second spur gear reduction stages 170, 182 may include any of a number of different ratios depending upon the desired speed reduction from the transmission 46. Alternatively, either of the first and second spur gear reduction stages 170, 182 may be replaced by a belt-drive arrangement utilizing pulleys of different sizes to achieve the desired speed reduction from the transmission 46.

With reference to FIG. 1, the powered dispensing tool 10 includes a quick-change assembly 186 for adapting different style and size cartridge housings to the main housing 14 of the tool 10 such that the tool 10 may be used with cardboard tube-style cartridges or sausage pack cartridges of different sizes. In the illustrated construction of the tool 10, the quick-change assembly 186 is configured as a collar 190 with internal threads (not shown) that is axially secured to the main housing 14 of the tool 10. The collar 190, however, is free to rotate relative to the housing 14. The cartridge housing 18 includes a universal connector having external threads (not shown) that correspond with the internal threads on the collar 190, such that cartridge housings of different sizes and styles may be secured to the main housing 14. No additional structure is utilized to interlock the cartridge housing 18 to the collar 190 to inhibit inadvertent removal of the housing 18 from the collar 190 and the main housing 14.

Likewise, the plunger 26 may be replaced with other plungers having different sizes or configurations than the plunger 26. The plunger 26 illustrated in FIG. 1 is configured for use with cardboard tube-style cartridges and the cartridge housing 18. Another plunger (not shown) may be used in conjunction with tubular cartridge housings (not shown) when dispensing material from a sausage pack.

Figure 7:
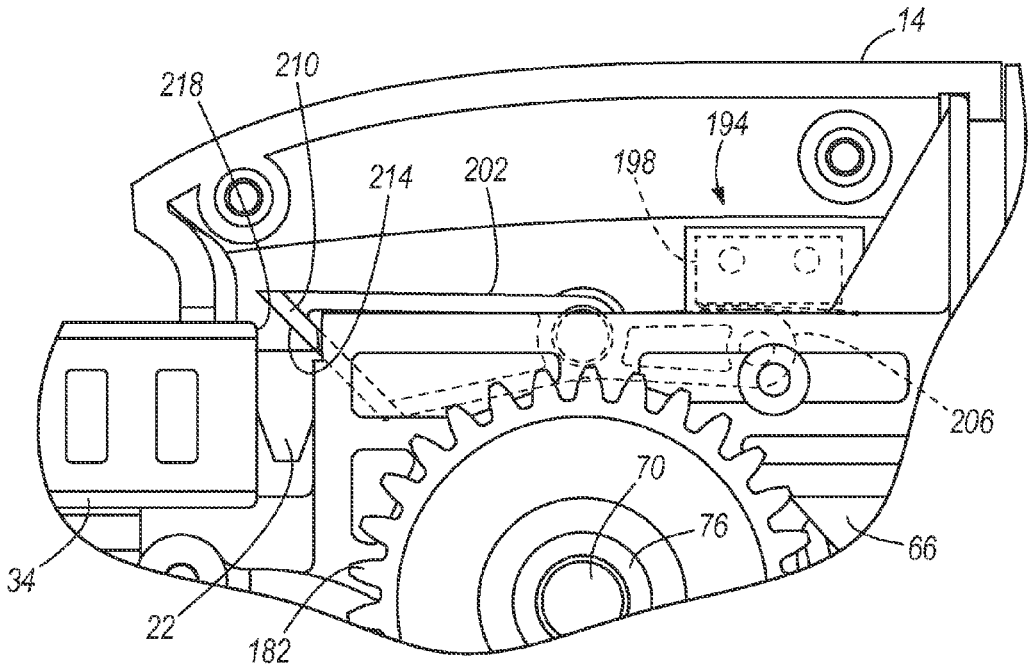
FIG. 7 is an enlarged view of a portion of the powered dispensing tool shown in FIG. 3, illustrating a switch of a stroke control circuit and an actuator pivoted to a first position for maintaining the switch in a closed configuration.
Figure 8:
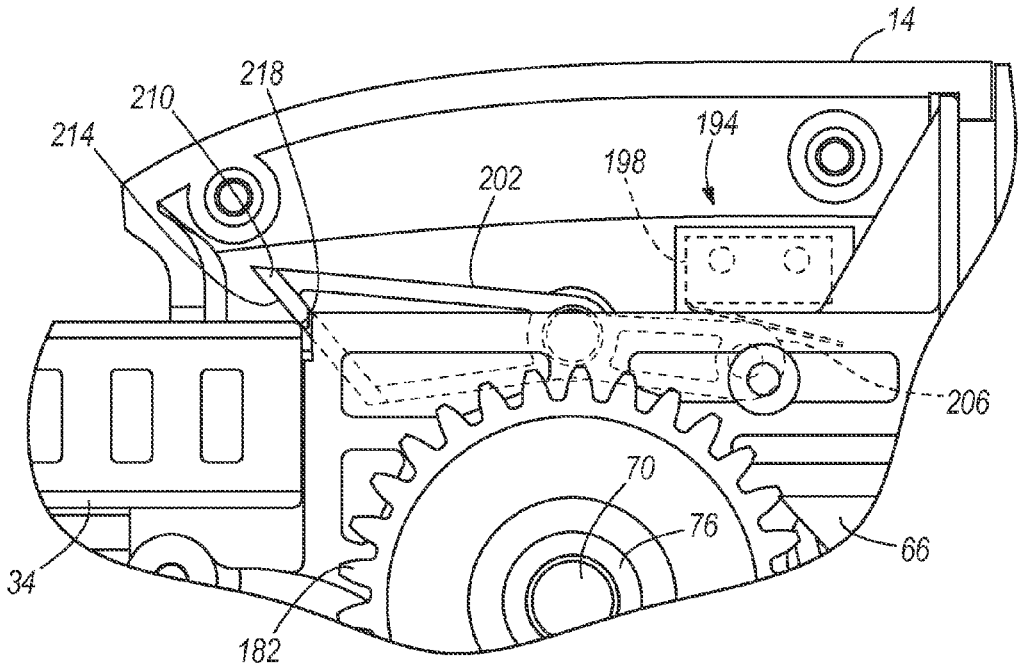
FIG. 8 is an enlarged view of a portion of the powered dispensing tool shown in FIG. 3, illustrating the actuator pivoted to a second position to permit the switch to assume an open configuration.

With reference to FIGS. 7 and 8, the tool 10 further includes a stroke-limit circuit 194 in electrical communication with the motor 42 and that is operable to deactivate the motor 42 to arrest powered translation of the rack 22 in the forward direction. The stroke-limit circuit 194 includes a switch 198 which, when toggled to a closed configuration (FIG. 7), supplies power to the motor 42 and when toggled to an open configuration (FIG. 8), does not supply power to the motor 42. The powered dispensing tool 10 also includes an actuator 202 positioned between the switch 198 and the rack 22 for toggling the switch 198 between the closed and open configurations. In the illustrated construction of the tool 10, the actuator 202 is pivotably coupled to the housing 14 and includes a first end 206 engageable with the switch 198 for toggling the switch 198 and a second end 210 engageable with a front end 218 of the handle 34 which, in turn, is mounted to the rack 22. Although not shown, a torsion spring may be utilized to bias the actuator 202 toward the orientation shown in FIG. 7. The second end 210 includes an inclined or ramp surface 214 that is engageable with the front end 218 of the handle 24 to pivot the actuator 202 from the orientation shown in FIG. 7 to the orientation shown in FIG. 8, in which the switch 198 is toggled to the open configuration. In this manner, the handle 34 is prevented from impacting the main housing 14 during advancement of the rack 22 or movement of the rack 22 in a forward, material-dispensing direction, thereby defining a predetermined stroke limit to the rack 22 and plunger 26.

The tool 10 also includes a current-monitoring circuit in electrical communication with the motor 42. Although not shown, the current-monitoring circuit may be a component of a top-level or master controller in the tool 10. Alternatively, the current-monitoring circuit may be a separate and stand-alone circuit not associated with any other controllers in the tool 10.

The rack 22 undergoes a relatively slow linear motion for dispensing caulk, adhesives, or other materials from cartridges. This slow linear dispensing speed is produced by reducing the motor speed through the transmission 46, followed by the output gear 82 driving the rack 22. In normal operation, the force developed by the rack 22 is within an acceptable range that will not affect the reliability of the tool 10. However, if the rack 22 encounters an obstacle that causes the motor speed to slow dramatically or stall completely, the amount of force developed by the rack 22 will increase substantially over a short period of time. Such an increased force may be large enough to damage to the transmission 46, the rack 22, or the cartridge housing 18. The current-monitoring circuit monitors this force and quickly takes corrective action should the force become too high.

The force developed by the rack 22 is proportional to the torque developed by the motor 42 which, in turn, is proportional to the motor current. Therefore, monitoring motor current provides a very good indication of the force exerted on the rack 22. If a motor current feedback signal rises at a rate higher than a predetermined value, the current-monitoring circuit will cease to drive the motor 42 and the rack 22 in the forward, material-dispensing direction, and will instead drive the motor 42 and the rack 22 in a reverse direction for a short interval before deactivating the motor 42. This condition may occur, for example, if a blockage is encountered within the cartridge which, in turn, prevents material from being discharged from the cartridge. A process for monitoring motor current, which can be implemented in the current-monitoring circuit, is shown and described in greater detail in published U.S. Patent Application No. 2010/0001017 (the "'017 Publication"), the entire contents of which is hereby incorporated by reference.

The tool 10 further includes a motor-control circuit in electrical communication with the motor 42. Although not shown, the motor-control circuit may be a component of a top-level or master controller in the tool 10. Alternatively, the motor-control circuit may be a separate and stand-alone circuit not associated with any other controllers in the tool 10.

When the trigger 54 is depressed, the motor-control circuit activates the motor 42. However, rather than immediately driving the motor 42 at a predetermined speed, or at a user-selected speed in accordance with the adjustment of a potentiometer in communication with the motor-control circuit, a soft-start feature of the dispensing tool 10 allows the rack 22, moving in the forward or material-dispensing direction, to be accelerated from rest to the predetermined or user-selected speed over a short period of time (i.e., typically less than one second). The motor-control circuit gradually increases the voltage applied to the motor 42, and in doing so reduces the peak current drawn by the motor 42 during startup. The motor-control circuit also reduces the peak torque delivered by the motor 42 during startup, and therefore provides smoother dispensing of material during startup. Further, incorporating the soft-start feature in the motor-control circuit increases the life expectancy and reduces wear of the tool 10. A process for providing the soft-start feature, which can be implemented in the motor-control circuit, is shown and described in greater detail in the '017 Publication.

The tool 10 also includes an auto-reverse circuit in electrical communication with the motor 42. Although not shown, the auto-reverse circuit may be a component of a top-level or master controller in the tool 10. Alternatively, the auto-reverse circuit may be a separate and stand-alone circuit not associated with any other controllers in the tool 10. A process for providing the auto-reverse feature, which can also be implemented in the aforementioned motor-control circuit, is shown and described in greater detail in the '017 Publication.

It is desirable to minimize or eliminate dispensing material from excreting from the tool 10 after operation has ceased. This can be achieved by providing a control scheme for momentarily reversing the rotational direction of the motor 42 after the user has released the trigger 54. After dispensing is halted, the material within the cartridge continues to expand within the cartridge. Momentary reversal of the motor 42 by the auto-reverse circuit causes the output shaft 70 to drive the rack 22 and the plunger 26 in a reverse direction, thereby allowing the material to expand within the material cartridge and alleviate the residual pressure within the cartridge from the dispensing operation.

In operation of the tool 10, the slide member 118 may be initially positioned in the release position to disengage the clutch member 90 from the output gear 82 (FIG. 6). As such, the output gear 82 may be rotated relative to the output shaft 90 in response to the operator grasping the handle 34 and pulling the rack 22 rearward to create sufficient spacing in the cartridge housing 18 for insertion of a tubular cartridge or a sausage pack containing caulk, adhesive, or other material to be dispensed. After the tubular cartridge or sausage pack is loaded, the rack 22 may be pushed forward to initially engage the plunger 26 with the rear of the tubular cartridge or sausage pack, causing the output gear 82 to rotate relative to the stationary output shaft 70.

To enable powered dispensing of the tool 10, the slide member 118 must be manually actuated from the release position (FIG. 6) to the drive position (FIG. 5), during which time the follower surface 130 on the lever 102 slides downwardly on the cam surface 122 of the slide member 118. The compression spring 132 is then permitted to exert a restoring force on the clutch member 90 to move the clutch member 90 from the second position (FIG. 6) to the first position (FIG. 5), causing the clutch member 90 to engage the output gear 82. Thereafter, the output gear 82 is drivably coupled to the motor 42 via the transmission 46.

When the user depresses the trigger 54, the motor 42 is activated to drive the output shaft 70, the clutch member 90, and the remainder of the transmission 46. The clutch member 90, in turn, rotates the output gear 82 and drives the rack 22 in a forward direction to dispense caulk, adhesive, or other material from the tubular cartridge or sausage pack. As discussed above, the motor-control circuit may implement the soft-start feature to slowly accelerate the motor 42 to a desired operating speed.

When the user releases the trigger 54, the auto-reverse circuit momentarily drives the motor 42 in a reverse direction to rotate the output gear 82 in a reverse direction, thereby driving the rack 22 rearward or in a reverse direction to permit the material within the material cartridge to expand and alleviate the residual pressure within the cartridge from the dispensing operation.

Should the user of the tool 10 desire to change material cartridges, the user may manually actuate the slide member 118 from the drive position (FIG. 5) to the release position (FIG. 6), thereby disengaging the clutch member 90 from the output gear 82. The rack 22 and the output gear 82 are then de-coupled from the motor 42 and the remainder of the transmission 46 such that the user of the tool 10 may grasp the handle 34 and pull to manually retract the rack 22 to change the cartridge.

Various features of the invention are set forth in the following claims.

What is claimed is:

1. A powered dispensing tool comprising:

a housing;

a motor at least partially positioned within the housing;

a rack operably coupled to the motor for powered translation in at least one of a forward direction and a reverse direction;

a transmission selectively operably coupling the motor and the rack, the transmission including an output shaft rotatable in response to rotation of the motor, an output member drivably coupled to the rack and supported on the output shaft for relative rotation therewith, and a clutch member coupled for co-rotation with the output shaft and movable along the output shaft between a first position, in which the clutch member is engaged with the output member for transferring torque from the output shaft to the output member, and a second position, in which the clutch member is disengaged from the output member to inhibit torque transfer between the output shaft and the output member; and an actuator coupled to the clutch member to facilitate moving the clutch member between the first and second positions, the actuator including a lever pivotably coupled to the housing and having a first end engageable with the clutch member and a second end, and a slide member supported by the housing for sliding movement between a drive position, in which the lever is allowed to pivot to move the clutch member toward the first position, and a release position, in which the lever is pivoted by the slide member to move the clutch member toward the second position;

wherein the second end of the lever is engaged by the slide member in the release position to maintain the clutch member in the second position.

2. The powered dispensing tool of claim 1, wherein the rack is manually translatable in the forward direction and the reverse direction when the clutch member is in the second position.

3. The powered dispensing tool of claim 1, wherein the actuator includes a compression spring engaged with the clutch member for biasing the clutch member toward the first position.

4. The powered dispensing tool of claim 1, wherein the transmission includes a plurality of planetary stages positioned between the motor and the output shaft.

5. The powered dispensing tool of claim 1, wherein the transmission includes at least one spur gear reduction stage positioned between the motor and the output shaft.

6. The powered dispensing tool of claim 1, wherein the output shaft includes a first portion having a non-circular cross-sectional shape upon which the clutch member is supported, and a second portion having a circular cross-sectional shape upon which the output member is supported.

7. The powered dispensing tool of claim 1, further comprising:

a trigger selectively depressed by a user of the tool to activate the motor for rotation in a first direction, and a control circuit electrically connected with the motor and operable to rotate the motor in a second direction in response to the user releasing the trigger.

8. The powered dispensing tool of claim 1, further comprising a stroke control circuit electrically connected to the motor and operable to deactivate the motor to arrest powered translation of the rack in the forward direction.

9. The powered dispensing tool of claim 8, wherein the stroke control circuit includes a switch, and wherein the powered dispensing tool further includes an actuator positioned between the switch and the rack for toggling the switch between a closed configuration, in which power is supplied to the motor, and an open configuration, in which power is not supplied to the motor.

10. The powered dispensing tool of claim 9, wherein the actuator is pivotably coupled to the housing and includes a first end engageable with the switch for toggling the switch and a second end engageable with the rack.

11. The powered dispensing tool of claim 1, further comprising a current monitoring circuit electrically connected to the motor and operable to deactivate the motor in response to the electrical current drawn by the motor exceeding a predetermined current threshold for a predetermined period of time.

12. The powered dispensing tool of claim 1, further comprising a motor control circuit electrically connected to the motor and operable to accelerate the motor to an operating speed in response to initial activation of the motor.

13. The powered dispensing tool of claim 1, further comprising a case at least partially enclosing the transmission.

14. The powered dispensing tool of claim 13, wherein the case is at least partially enclosed by the housing.

15. The powered dispensing tool of claim 1, further comprising:

a plunger coupled to one end of the rack, and a cartridge housing coupled to the housing and defining a longitudinal axis.

16. The powered dispensing tool of claim 15, wherein the plunger is movable within the cartridge housing along the longitudinal axis in response to powered translation of the rack in the forward direction, and in response to manual translation of the rack in the forward and reverse directions.

* * * * *